US007262394B2

(12) United States Patent
August

(10) Patent No.: US 7,262,394 B2
(45) Date of Patent: Aug. 28, 2007

(54) MORTAR SHELL RING TAIL AND ASSOCIATED METHOD

(75) Inventor: Henry August, Chatsworth, CA (US)

(73) Assignee: The Boeing Company, Chicago, IL (US)

( * ) Notice: Subject to any disclaimer, the term of this patent is extended or adjusted under 35 U.S.C. 154(b) by 43 days.

(21) Appl. No.: 10/793,984

(22) Filed: Mar. 5, 2004

(65) Prior Publication Data

US 2005/0224631 A1 Oct. 13, 2005

(51) Int. Cl.
*F42B 10/00* (2006.01)

(52) U.S. Cl. ..... 244/3.3

(58) Field of Classification Search ..... 244/3.1, 244/3.11, 3.24, 3.25, 3.26, 3.27, 3.28, 3.29, 244/3.3, 12.6, 34 A, 3.15, 3.21, 3.22; 102/525, 102/473; 446/34, 48; 114/22, 23, 152, 166, 114/21.1, 16, 14, 238, 239, 318, 330–333, 114/21.2; 440/42, 67; 744/3.26
See application file for complete search history.

(56) References Cited

U.S. PATENT DOCUMENTS

| | | | | | |
|---|---|---|---|---|---|
| 17,173 | A | * | 4/1857 | Sibley | 244/3.26 |
| 18,568 | A | * | 11/1857 | Bates | 244/3.3 |
| 45,567 | A | * | 12/1864 | Stafford | 102/525 |
| 46,490 | A | * | 2/1865 | Orwig | 102/501 |
| 93,089 | A | * | 7/1869 | Hotchkiss | 102/525 |
| 229,499 | A | * | 6/1880 | Turner | 244/3.27 |
| 1,098,230 | A | * | 5/1914 | Dallier | 114/23 |
| 1,278,786 | A | * | 9/1918 | Teleszky | 102/436 |
| 1,417,460 | A | * | 5/1922 | Driggs, Jr. | 102/439 |
| 2,359,515 | A | * | 10/1944 | Fanger | 244/3.26 |
| 2,393,604 | A | * | 1/1946 | Berger | 102/385 |
| 2,494,885 | A | * | 1/1950 | Lax et al. | 102/385 |
| 2,584,826 | A | * | 2/1952 | Wyckoff | 102/384 |
| 2,694,364 | A | * | 11/1954 | Liljegren | 102/373 |
| 2,700,458 | A | * | 1/1955 | Brown | 206/319 |
| 2,850,977 | A | * | 9/1958 | Pollak | 244/3.22 |
| 2,868,478 | A | * | 1/1959 | McCloughy | 244/3.22 |
| 2,890,670 | A | * | 6/1959 | Le Francois | 114/22 |

(Continued)

OTHER PUBLICATIONS

A guided projectile/mortar aerodynamic control concept—The trailing ring-tail; Murad, P. A. (Bendix Corp., Guidance Systems Div., Teterboro, NJ); AIAA-1984-77, American Institute of Aeronautics and Astronautics, Aerospace Sciences Meeting, 22nd, Reno, NV, Jan. 9-12, 1984. 16 p.*

*Primary Examiner*—Stephen A Holzen
(74) *Attorney, Agent, or Firm*—Alston & Bird LLP

(57) ABSTRACT

There is provided a ring tail for a ballistic projectile and an associated method that facilitate maneuverability of the ballistic projectile. The ring tail comprises a ring member having a generally cylindrical wall and at least one rod joined to an aft section of the ballistic projectile and the ring member. The rod defines an adjustable length, wherein an actuation device joined to the at least one rod adjusts the length to thereby maneuver the ballistic projectile during flight. The ring tail may include generally radially oriented panels and may also include a second ring member joined to the distal ends of the panels such that the ring members are coaxial. Once the projectile has been launched, the ring member extends aftward to provide aerodynamic stability, which may be measured by a guidance sensor in electronic communication with the actuation device that adjusts the length of the at least one rod.

13 Claims, 2 Drawing Sheets

U.S. PATENT DOCUMENTS 2,936,710 A * 5/1960 Bollay ..... 244/3.21
2,992,794 A * 7/1961 Boyd ..... 244/3.15
3,065,932 A * 11/1962 Herrmann ..... 244/15
3,104,641 A * 9/1963 Froehlich ..... 114/330
3,107,883 A * 10/1963 Haberkorn ..... 244/15
3,113,517 A * 12/1963 Kelley et al. ..... 102/385
3,135,484 A * 6/1964 Herrmann ..... 244/76 R
3,145,949 A * 8/1964 Smith, Jr. ..... 244/3.16
3,251,301 A * 5/1966 Herrmann ..... 244/3.25
3,267,854 A * 8/1966 Michelson ..... 89/1.808
3,374,969 A * 3/1968 Rhodes ..... 244/3.27
3,603,533 A * 9/1971 Stripling ..... 244/3.23
3,706,293 A * 12/1972 Hancks et al. ..... 114/20.1
3,717,114 A * 2/1973 Bernaerts ..... 114/338
3,724,782 A * 4/1973 Gauzza et al. ..... 244/3.27
3,764,091 A * 10/1973 Crowhurst ..... 244/3.22
3,861,627 A * 1/1975 Schoffl ..... 244/3.27
3,902,684 A * 9/1975 Queeney ..... 244/3.14
3,903,639 A * 9/1975 Howell ..... 446/57
3,993,269 A * 11/1976 Crosby, Jr. ..... 244/33
4,024,998 A * 5/1977 Rabinow et al. ..... 244/3.26
4,037,807 A * 7/1977 Johnston et al. ..... 244/7 B
4,153,223 A * 5/1979 Romer et al. ..... 244/3.1
4,351,503 A 9/1982 Drori
4,413,567 A * 11/1983 Frostig ..... 102/525
4,431,147 A * 2/1984 Paley ..... 244/3.3
4,497,460 A * 2/1985 Thorsted et al. ..... 244/3.3
4,534,294 A * 8/1985 von Laar et al. ..... 102/520
4,579,298 A * 4/1986 Thomson ..... 244/3.21
4,623,107 A * 11/1986 Misoph ..... 244/3.22
4,708,304 A * 11/1987 Wedertz et al. ..... 244/3.26
4,748,912 A 6/1988 Garcia ..... 102/473
4,804,155 A * 2/1989 Strumbos ..... 244/12.6
4,832,288 A * 5/1989 Kendall et al. ..... 244/160
4,833,993 A 5/1989 Garcia-Garcia ..... 102/340
H000854 H * 12/1990 Madderra ..... 244/3.28
5,003,909 A * 4/1991 Moody ..... 114/238
5,078,337 A * 1/1992 Waller ..... 244/3.28
5,086,993 A * 2/1992 Wainfan ..... 244/48
5,114,095 A * 5/1992 Schroppel et al. ..... 244/3.28
5,186,117 A * 2/1993 Stallard, III ..... 114/330
5,194,012 A * 3/1993 Cairns ..... 439/201
5,199,151 A * 4/1993 Wentworth et al. ..... 29/437
5,253,473 A * 10/1993 Duva ..... 60/39.462
5,374,013 A * 12/1994 Bassett et al. ..... 244/130
5,417,393 A * 5/1995 Klestadt ..... 244/3.27
5,615,847 A * 4/1997 Bourlett ..... 244/63
5,685,503 A * 11/1997 Trouillot et al. ..... 244/3.28
5,708,232 A * 1/1998 Nedderman, Jr. ..... 114/23
5,762,291 A * 6/1998 Hollis et al. ..... 244/3.24
5,775,636 A * 7/1998 Vig et al. ..... 244/3.24
5,804,759 A * 9/1998 Sauvestre ..... 102/439
5,816,531 A * 10/1998 Hollis et al. ..... 244/3.27
RE36,487 E * 1/2000 Wainfan ..... 244/48
6,223,676 B1 * 5/2001 Lafountain ..... 114/330
6,247,666 B1 * 6/2001 Baker et al. ..... 244/3.21
6,257,148 B1 7/2001 Toivonen et al. ..... 102/439
6,295,934 B1 * 10/2001 Tepera et al. ..... 102/525
6,297,486 B1 * 10/2001 Rom et al. ..... 244/3.3
6,360,987 B1 * 3/2002 Sallaee et al. ..... 244/3.21
6,369,373 B1 * 4/2002 Tepera et al. ..... 244/3.3
6,453,821 B1 9/2002 Fowler et al. ..... 102/527
6,454,205 B2 * 9/2002 Niemeyer et al. ..... 244/3.26
6,572,422 B2 * 6/2003 Kirkwood et al. ..... 440/67
6,610,971 B1 * 8/2003 Crabtree ..... 244/3.1
6,637,699 B2 * 10/2003 Banks et al. ..... 244/3.21
6,640,720 B1 * 11/2003 Biserød ..... 102/377
6,645,020 B1 * 11/2003 Barker ..... 440/71
6,659,393 B1 * 12/2003 Biserød ..... 244/3.24
6,708,923 B2 * 3/2004 Kusic ..... 244/34 R
6,723,972 B2 * 4/2004 Schroeder et al. ..... 244/3.3
6,764,044 B2 * 7/2004 Kusic ..... 244/75 R
6,869,043 B1 * 3/2005 Carlyle et al. ..... 244/3.28
2002/0079404 A1 * 6/2002 Schroeder et al. ..... 244/3.3
2004/0065248 A1 * 4/2004 Gieseke ..... 114/330

* cited by examiner

MORTAR SHELL RING TAIL AND ASSOCIATED METHOD

BACKGROUND OF THE INVENTION

1. Field of the Invention

The present invention is related to ballistic projectiles, and more particularly, to a device and method that facilitate maneuverability of ballistic projectiles.

2. Description of Related Art

Mortar shells are barrel-launched ballistic projectiles that are typically used for military applications. The efficacy of the mortar shell typically depends upon the maximum accuracy and range the mortar shell provides. The accuracy of the mortar shell is affected by the atmospheric conditions that the mortar shell experiences during the flight path of the mortar shell. Such atmospheric conditions may include turbulence or unsteady winds that may cause the mortar shell to diverge from its intended flight path. Mortar shells are typically used in situations where the atmospheric conditions are unpredictable; therefore, compensating for these conditions prior to launching of the mortar shell may be difficult. Furthermore, mortar shells are typically rigid projectiles that are not capable of adjusting their trajectory during flight to compensate for atmospheric conditions.

The range of the mortar shell is affected by the amount of charge used to launch the mortar shell and the angle at which the mortar shell is launched. Mortar shells are typically launched by a propelling charge, which is provided either with the mortar shell or is provided separately during the loading of the mortar shell. The range of a mortar shell launched with separately provided charge can be controlled by the amount of charge provided. However, once the mortar shell has been launched, no additional propellant is typically provided; therefore, the range of the mortar shell is dependent upon the amount of charge used and/or the angle at which the mortar shell was launched. It should be noted that every mortar shell and/or launch device defines a maximum amount of charge that it can withstand, thus limiting the maximum range of the mortar shell. Accordingly, the accuracy and range of a mortar shell are limited.

A need exists for a mortar shell that is maneuverable during the flight path of the mortar shell to increase the accuracy and range of the mortar shell. Such a device advantageously could be used with existing mortar shell designs and launch devices.

BRIEF SUMMARY OF THE INVENTION

A ring tail is provided according to the present invention for maneuvering a mortar shell during the flight path of the mortar shell. The ring tail is joined to an aft section of the mortar shell, and it extends aftward after the mortar shell has been launched to aerodynamically control the launched mortar shell. The orientation of the ring tail is advantageously adjusted during the flight path to compensate for atmospheric conditions or other undesirable affects that diminish accuracy and to provide additional lift for improved range capability. The ring tail is also capable of being mounted to existing mortar shell designs, even retrofitted to existing mortar shells, and may be used with existing launch devices.

According to the present invention, a ring tail that is joined to a ballistic projectile, such as a mortar shell, comprises a ring member having a wall with a forward end and an aft end. The wall advantageously defines a generally cylindrical wall. One embodiment comprises a plurality of generally radially oriented panels that are joined to an outer surface of the generally cylindrical wall. A still further embodiment of the present invention comprises a second ring member joined to a distal end of the panels such that the two ring members are coaxial to provide further aerodynamic control of the mortar shell.

At least one rod joins the ring tail to the aft section of the mortar shell. The rod has a length that is measured from the forward portion of the rod attached to the mortar shell to an aft portion of the rod attached to the ring member. Advantageously, the rod comprises a compressed coil rod or a telescoping rod. The ring tail also comprises an actuation device that adjusts the length of the rod during the flight path of the mortar shell to thereby maneuver the mortar shell.

A method is also provided according to the present invention for maneuvering a ballistic projectile during the flight path of the ballistic projectile. After the ballistic projectile has been launched, at least one rod that joins a ring member to the ballistic projectile is extended in an aftward direction so that the ring member is located a distance from the aft section of the ballistic projectile. The length of the at least one rod is then adjusted to move the ring member relative to the ballistic projectile and to provide aerodynamic control so that the ballistic projectile may be maneuvered.

Therefore, embodiments of the present invention facilitate maneuverability of a ballistic projectile, such as a mortar shell, during the flight path of the ballistic projectile. This maneuverability provides for improved accuracy and range of the ballistic projectile. Furthermore, embodiments of the present invention may be used with existing mortar shell designs and launch devices.

BRIEF DESCRIPTION OF THE SEVERAL VIEWS OF THE DRAWINGS

Figure 1:
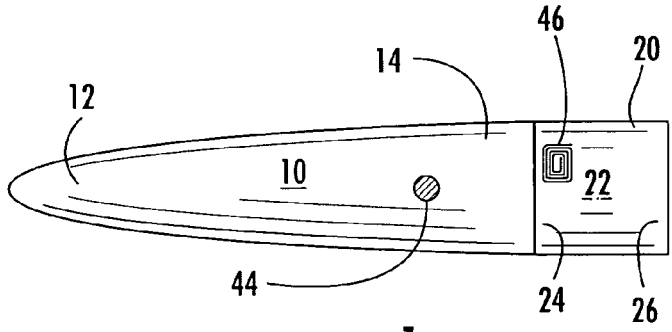
Figure 2:
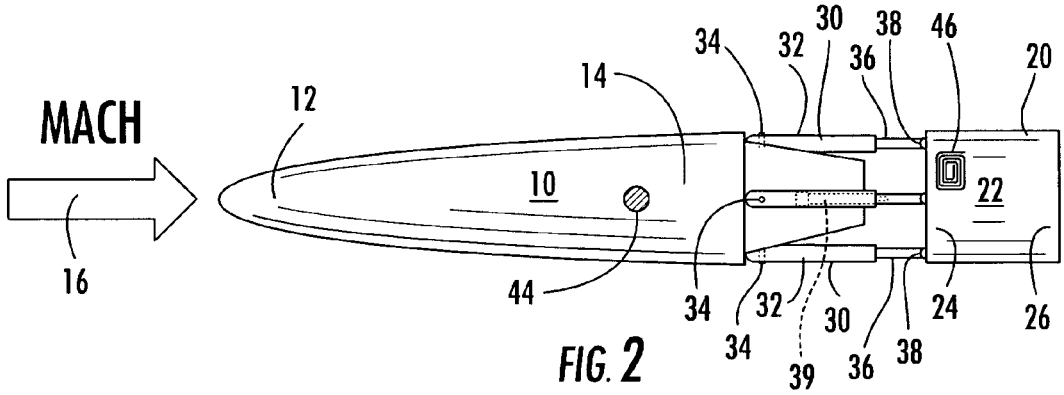
Figure 3:
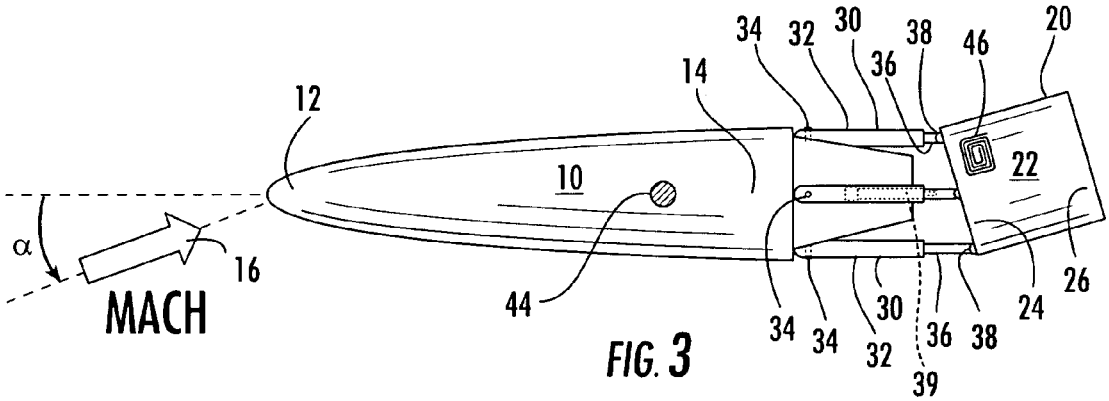
Figure 4:
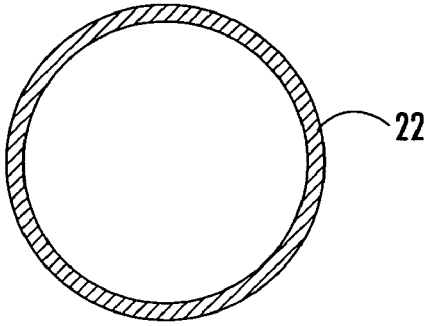
Figure 5:
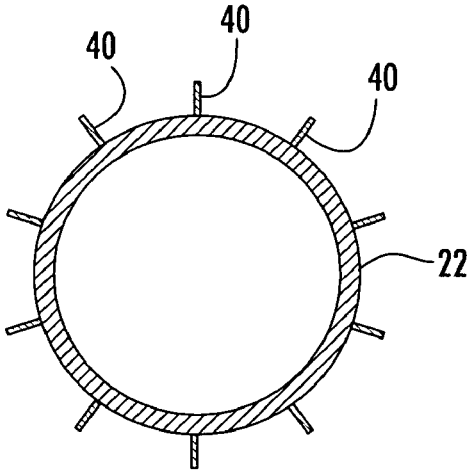
Figure 6:
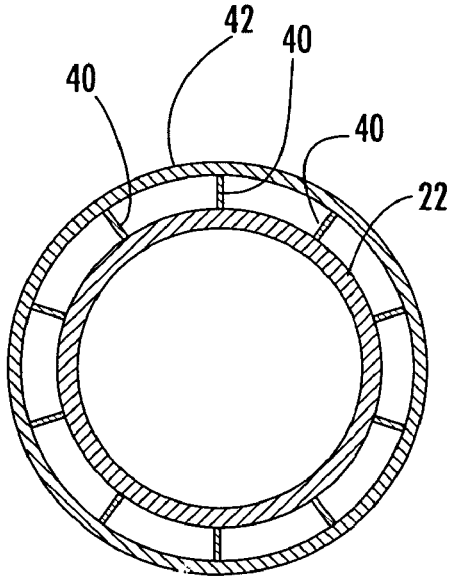

Having thus described the invention in general terms, reference will now be made to the accompanying drawings, which are not necessarily drawn to scale, and wherein:

FIG. 1 is a side elevational view of a mortar shell comprising a ring tail in accordance with one embodiment of the present invention, illustrating the ring tail in the compressed position;

FIG. 2 is a side elevational view of the mortar shell of FIG. 1, illustrating the ring tail located a distance from the aft section of the mortar shell;

FIG. 3 is a side elevational view of the mortar shell of FIG. 1, illustrating the ring tail with the lengths of the rods adjusted to maneuver the mortar shell;

FIG. 4 is a cross-sectional view of the ring tail of FIG. 1;

FIG. 5 is a cross-sectional view of the ring tail in accordance with a second embodiment of the present invention, illustrating a ring tail with generally radially oriented panels; and FIG. 6 is a cross-sectional view of the ring tail in accordance with a third embodiment of the present invention, illustrating a ring tail with generally radially oriented panels and a second ring member joined to a distal end of the generally radially oriented panels.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

With reference to FIGS. 1-4, a ballistic projectile in accordance with one embodiment of the present invention is illustrated. The ballistic projectile of the illustrated embodiments comprises a barrel-launched mortar shell 10; however, it should be appreciated that the present invention may be used with any ballistic projectile, including torpedoes, to list one non-limiting example. The ring tail of the present invention is joined to the mortar shell 10 to facilitate maneuverability of the mortar shell during its flight path to advantageously improve the accuracy and range of the mortar shell.

The mortar shell 10 of FIGS. 1-3 defines a forward section 12 and an aft section 14 opposed thereto, wherein the forward section is generally the front portion of the mortar shell forward of the center of gravity in the direction of the flight path. Accordingly, the aft section 14 is generally the portion of the mortar shell aft of the center of gravity in a direction opposite the flight path. FIG. 1 illustrates the mortar shell 10 in a configuration prior to being launched. FIG. 2 illustrates the mortar shell 10 during flight at a zero angle of attack, where the direction of flight is generally represented by the arrow 16, and FIG. 3 illustrates the mortar shell 10 during flight at an angle of attack represented by angle $\alpha$. The angle of attack is generally defined as the angle between the direction of flight and a central axis of the mortar shell. The mortar shell 10 defines an angle of attack along a vertical direction, or the pitch, as in FIGS. 2 and 3, and along a lateral direction, or the yaw, (not shown) that is orthogonal to the pitch. The mortar shell 10 is preferably maintained at a zero angle of attack in pitch, as well as yaw, by the ring tail 20 of the present invention, thereby providing aerodynamic stability to the mortar shell.

The ring tail 20 of FIGS. 1-6 comprises a ring member 22 having a wall with a forward end 24 and an aft end 26 opposed thereto. The forward end 24 is generally the front portion of the ring member 22 and the aft end 26 is generally the rear portion of the ring member. The ring member 22 of the illustrated embodiments comprises a wall that advantageously defines a generally cylindrical wall. Further embodiments of the present invention may comprise a wall that defines alternative shapes, such as polygonal, elliptical, or the like to list a few non-limiting examples. The ring member 22 of the ring tail 20 advantageously defines an outer periphery, such as circular or polygonal to list two non-limiting examples, that comprises no surfaces along the periphery that are located at a greater distance in a radial direction from a central axis of the mortar shell than the outer periphery of the mortar shell 10 itself. Thus, the ring member will be able to safely pass through the barrel of the launch device (not shown) when the mortar shell is launched. Advantageously, the ring member 22 defines an outer surface that is shaped and sized generally comparable to the shape and size of the mortar shell 10 to provide desirable aerodynamic performance during the launch and flight path of the mortar shell. The ring member 22 of the ring tail 20 also defines an axial length, and advantageously the axial length is proportionate in size to the mortar shell 10 to which it is attached so that it is capable of providing sufficient aerodynamic stability to the mortar shell.

The ring tail 20 of the present invention also comprises at least one rod 30 that joins the ring member 22 to the mortar shell 10. In particular, the ring tail 20 of FIGS. 2 and 3, comprises four rods 30 that are located generally 90 degrees apart. Further embodiments of the present invention may comprise alternative numbers of rods. The rods of the illustrated embodiment define generally cylindrical rods. However, further embodiments of the present invention may comprise rods that define alternative cross-sectional shapes, such as elliptical or polygonal to list two non-limiting examples, provided the rods define an adjustable length.

Each rod 30 has a forward portion 32 structured and arranged for joining to an aft section 14 of the mortar shell 10. The rods 30 of the illustrated embodiment are joined with a pin device 34 that allows each rod to pivot about the pinned forward end 32. The forward portion 32 of the rod 30 generally comprises the forward section of the rod such that the pin device 34 may be located at any position along the forward section of the rod. The pin device 34 advantageously defines a lock pin that is locked into an aperture in the mortar shell 10, wherein the aperture is structured and arranged for receiving the lock pin. Further embodiments of the present invention may include alternative pin devices or may include alternative devices for joining the rod to the mortar shell, such as a ball joint to list one non-limiting example. Alternative devices for joining the rod to the mortar shell may also include additional components, such as a ring that rigidly joins the perimeter of the mortar shell, to list another non-limiting example.

Each rod 30 also has an aft portion 36 that is joined to the forward end 24 of the ring member 22 of the ring tail 20. The aft portion 36 of the rod 30 generally comprises the aft section of the rod such that the ring member 22 may be joined at any position along the aft section of the rod. It should be appreciated that even though the forward portions 32 and aft portions 36 of the rods 30 are generally the forward and aft sections, respectively, the forward portion that is joined to the aft section of the mortar shell need only be forward of the section of the rod that is joined to the forward end of the ring tail. The aft portion 36 of the rod 30 advantageously comprises a ball joint device 38 that joins the rod to the ring member 22 and provides for ball joint-type action of the ring member relative to the rod. Further embodiments of the present invention may include alternative devices for joining the rod to the ring member and may also provide for various types of relative motion between the rod and ring member.

The rod 30 has a length as measured between the forward portion 32 and the aft portion 36, such that the length is measured from the point where the forward portion joins the aft section 14 of the mortar shell 10, and the point where the aft portion joins the forward end 24 of the ring member 22. For the ring tail 20 of FIGS. 2 and 3, the length of the rod 30 is advantageously measured between the pin device 34 and the ball joint device 38. Further embodiments of the present invention may have a length measured from any suitable position on the forward portion to any suitable position on the aft portion.

The rods 30 of FIGS. 2 and 3 comprise a telescoping rod so that the length of each rod is adjustable. Adjusting the length of one or more rods, independently or relative to another rod or rods, maneuvers the mortar shell 10 during the flight path of the mortar shell. For the ring tail 20 of FIG. 3, the length of the uppermost rod 30 is adjusted such that it is shorter than a length of the lowermost rod 30 so that the ring member 22 of the ring tail is canted relative to the mortar shell 10 and is canted relative to the airflow around the ring member. This canting of the ring member 22 creates aerodynamic forces on the ring tail 20 that are imposed on the mortar shell 10 through the rods 30. The orientation, timing, and magnitude of the aerodynamic forces are advantageously adjusted by changing the angle of the ring member 22 relative to the airflow to provide for aerodynamic stability for the mortar shell 10 during the flight path.

The telescoping rods 30 of FIGS. 2 and 3 each comprise at least one rod within a hollow rod. The inner rod 36 of FIGS. 2 and 3 is slidably mounted within the outer rod 32 such that the inner rod may slide in an axial direction relative to the outer rod. The relative sliding of the inner rod 36 and outer rod 32 adjusts the length of the rod 30 to thereby maneuver the mortar shell 10. Further embodiments of the present invention may comprise rods that are compressed coil rods wherein the rod comprises a material with a memory, such that the compressed coil rods are predisposed to define a particular length and the length of the rod is adjusted by providing forces that counteract the compressive forces of the compressed coil rods. Still further embodiments of the present invention may comprise alternative rods that provide for adjusting the length of the rods.

The length of the rod 30 is adjusted with an actuation device operably joined to the rod. The actuation device 39 is advantageously an electromechanical linear actuator; however, further embodiments of the present invention may comprise alternative actuation devices, such as an electrical linear actuator, a mechanical linear actuator, or non-linear actuation devices, to list a few non-limiting examples. The actuation device 39 is joined to at least one rod 30 to be in mechanical communication with the rod to adjust the length of the rod by moving the forward portion of the rod and/or the aft portion of the rod relative to one another. The actuation device 39 is advantageously mounted within the rod 30, as shown in FIGS. 2 and 3; however, the actuation device may be mounted to the ring member 22 or the mortar shell 10 in further embodiments of the present invention. For the illustrated embodiments with the telescoping rods 30, the actuation device 39 axially moves the inner rod 36 and/or the outer rod 32 relative to each other. For further embodiments with the compressed coil rods, the actuation device advantageously provides forces to counteract the compressive forces so that the forward portion and the aft portion axially move relative to one another. Still further embodiments define alternative actuation devices for adjusting the length of the at least one rod of the ring tail.

Referring again to FIG. 1, before the mortar shell is launched, the ring tail 20 is advantageously in a compressed position such that the ring member 22 is proximate the mortar shell 10. This compressed position of the ring tail 20 facilitates the launching of the mortar shell 10 and minimizes any adverse effects the ring tail could have on the launch of the mortar shell. After the mortar shell 10 is launched, typically using an instantaneous charge, the at least one rod 30 is extended in an aftward direction so that the ring member 22 of the ring tail 20 is located a distance from the aft section 14 of the mortar shell 10, as shown in FIG. 2. Advantageously, the ring member 22 is extended aftward by compressive forces within the rods 30 or by the actuation devices 39 in mechanical communication with the rods. The distance between the ring member 22 and the mortar shell 10 provides for air (or water if the ring member is on a torpedo) to contact the ring member in such a way that the ring tail 20 is capable of providing forces to the mortar shell for maneuvering the mortar shell. These forces are created by the aerodynamic interaction of the ring member 22 and the air, and the direction and magnitude of forces created depend upon the orientation of the ring member relative to the airflow around the ring member. The orientation of the ring member 22 relative to the airflow is controlled by adjusting the length of the rods 30. FIG. 3 illustrates a canted ring member 22 where a length of a first rod on the lower side of the illustrated mortar shell is increased and a length of a second rod on the upper side of the mortar shell is decreased. The canted ring member 22 of the ring tail 20 generates forces to stabilize or orient the mortar shell 10 during the flight path. For the mortar shell 10 of FIG. 3, the ring member 22 is canted at an angle generally equivalent to the angle of attack $\alpha$ of the mortar shell 10. Therefore, the air flows around and through the ring member 22 generally axially so relatively small forces are generated. However, if the ring member 22 were canted the amount shown in FIG. 3 and the mortar shell 10 was at a zero angle of attack as in FIG. 2, the ring tail 20 would generate a generally downward force because of pressure differentials on the surface of the ring member that would cause the mortar shell to rotate in a clockwise rotation. In addition, the ring member 22 can be oriented so that lift forces are generated to increase the range of the mortar shell 10. For the illustrated mortar shell 10 of FIGS. 2, and 3, if the lower rod 30 were shorter than the upper rod, such that the ring member 22 were canted in an equal and opposite angle relative to the midplane of the mortar shell, the ring member would create generally upward lift forces that would generally increase the range of the mortar shell.

FIG. 4 shows a ring member 22 of the ring tail 20, as viewed along the axis of the ring member, wherein the ring member defines a generally cylindrical wall. Further embodiments of the present invention may incorporate additional features on the ring member 22 to increase the performance of the ring tail 20. FIG. 5 illustrates an additional embodiment comprising a plurality of generally radially oriented panels 40 that are joined to an outer surface of the ring member 22. The generally radially oriented panels 40 provide aerodynamic stability in a roll direction, which is generally along the central axis of the mortar shell 10. Advantageously, the generally radially oriented panels 40 are equally spaced about the ring member 22, as shown in FIG. 5. The generally radially oriented panels 40 of the illustrated embodiments comprise flat panels. Further embodiments of the present invention may comprise one or more generally radially oriented panels that are spaced at any relative locations and define alternative shapes, such as airfoils, ribs, apertures, or the like, to list non-limiting examples. Still further embodiments of the present invention may comprise one or more panels that are oriented in any direction relative to the ring member. Additional embodiments may also comprise one or more panels joined to the inner surface of the ring member.

FIG. 6 illustrates another embodiment of the present invention wherein the ring member 22 comprises a second ring member 42 having a generally cylindrical wall with an inner surface and an outer surface opposed thereto. The second ring member 42 is joined to a distal end of each generally radially oriented panel 40 such that the ring member 22 (which may also be referred to as the first ring member for the embodiment of FIG. 6) and the second ring member 42 are coaxial. The second ring member 42 provides additional forces to facilitate maneuvering of the mortar shell 10 and provides additional structural support for the generally radially oriented panels 40. Advantageously, the second ring member 42 defines a wall with an axial length generally equivalent to the first ring member 22; however, in further embodiments the two ring members may define dissimilar lengths. Advantageously, the rods 30 of the ring tail 20 are joined to the first ring member 22; however, further embodiments may comprise rods of the ring tail that are joined to the outermost ring member, such as the second ring member 42 of FIG. 6. In such embodiments with the rods joined to the outermost ring member, the outermost ring member is considered a first ring member with the panels joined to the inner surface of the first ring member and the second ring member joined to the innermost ends of the panels. Alternative combinations of the rods, ring members, and panels are also included in the present invention.

The ring member 22 of the illustrated embodiments may be manufactured as a unitized structure typically of high temperature steel. The first ring member 22, the generally radially oriented panels 40, and the second ring member 42 may all comprise a unitized structure of high temperature steel, wherein the various components are joined by welding, forming, fastening, or the like to list non-limiting examples, such that the ring member defines a unitized structure. In further embodiments of the present invention, the ring member 22 may comprise a unitized structure of composite material. Still further embodiments of the present invention may comprise alternative materials suitable to withstand the launching of the mortar shell and robust enough to undergo the forces generated during the flight path.

The mortar shell 10 of FIGS. 1-3 comprises a guidance sensor 44 mounted to mortar shell. The guidance sensor 44 advantageously comprises sensors to detect velocity, angular orientation of mortar shell 10, altitude, location, and/or other measurements related to the flight path of the mortar shell. The data relating to the flight path of the mortar shell 10 determined by the guidance sensor is advantageously transmitted to a receiving device remote from the mortar shell that processes the data to determine the accuracy of the mortar shell, which may be used to adjust the launch device accordingly for subsequent mortar shells. Further embodiments of the present invention may process the data determined by the guidance sensor for alternative applications.

The data determined by the guidance sensor 44 is advantageously used by the ring tail 20 to determine the amount of forces required to maneuver the mortar shell to compensate for atmospheric conditions, such as turbulence, or to increase the range of the mortar shell. These determinations are generally made instantaneously so that the ring tail 20 is capable of adjusting the length of the at least one rod 30 to generate the desired forces to maneuver the mortar shell 10. Advantageously, the lengths of two or more rods 30 are adjusted to provide greater changes in orientation of the ring tail 20, as in FIG. 3, and correspondingly increase the amount of forces generated to maneuver the mortar shell 10. The data from the guidance sensor 44 is processed, such as by processing circuitry such as one or more microprocessors or other computing devices, and the processed data results in a signal to control the actuation device of each rod 30, which adjusts the length of the rod accordingly. Therefore, some embodiments of the present invention may not require an antenna because the guidance sensor 44 and the actuation devices are in electrical communication for maneuvering the mortar shell 10. Advantageously, the desired flight path characteristics, such as angle of attack in pitch and yaw or such as range, to list two non-limiting characteristics, are programmed into the logic or other processing circuitry of the guidance sensors 44 and/or ring tail 20 so that the launched mortar shell 10 autonomously senses the current flight path characteristics in real time, determines the difference between the current and the desired flight path characteristics, determines the forces required to maneuver the mortar shell to have the desired flight path characteristics, and adjusts the lengths of the rods 30 to provide the forces necessary to achieve the desired flight path characteristics. Determinations of the requisite forces for correcting the flight path characteristics and the manner in which the rods are moved to reposition the ring member to generate those requisite forces are provided by predefined algorithms implemented by the processing circuitry in a manner known to those skilled in the art. Alternatively, the current flight path characteristics can be transmitted by an antenna or similar device to a remote station which receives the characteristics, determines the forces required to maneuver the mortar shell, and transmits commands to the actuation device operably joined to the rods. Further embodiments of the present invention define alternative techniques to correlate the guidance sensor data to the actuation devices, and still further embodiments of the present invention may comprise no guidance sensor, such that the ring tail is structured to maintain stability mechanically such that the mortar shell is maneuvered in a predetermined fashion.

The ring tail 20 of the mortar shell 10 of FIGS. 1-3 comprises an antenna 46 mounted to the ring member 22 to facilitate the transmission of data from the guidance sensor to a receiving device remote from the mortar shell that processes the data, as described above. The antenna 46 of FIGS. 1-3 is a loop antenna mounted on the outer surface of the ring member 22 in an optimal pattern to provide sufficient transmission of the data from the guidance sensor 44. The antenna of alternative embodiments may be defined inside the ring member or on the inner surface of the ring member. The guidance sensor 44 in conjunction with the antenna 46 advantageously comprises an active transponder to transmit the signal; however, further embodiments of the present invention may comprise a passive transponder that is powered by signals received from the remote receiving device, such as a passive radio frequency antenna system. The transmitted signals are advantageously radio frequency signals; however, further embodiments of the present invention may transmit alternative signals. Still further embodiments of the present invention comprise antennas of various shapes, patterns, sizes, materials, and functions, to list a few non-limiting antenna characteristics.

The ring tail 20 of the present invention is advantageously structured and arranged for joining to a ballistic projectile, such as a mortar shell 10, without requiring significant design changes for the ballistic projectile. This compatibility between the ring tail 20 of the present invention allows the ring tail to be used in existing launch devices with existing mortar shells 10, or other ballistic projectiles, and also permits the ring tail to be retrofitted onto existing mortar shells.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A ring tail for facilitating maneuverability of a ballistic projectile launched from a barrel to define a flight path, the ring tail comprising:

a ring member having a wall with a forward end and an aft end opposed thereto, wherein during the flight path of the ballistic projectile air is capable of flowing around and through the ring member;

at least one rod having a forward portion structured and arranged for joining to an aft section of the ballistic projectile and an aft portion joined to the forward end of the ring member, wherein the at least one rod has a length as measured between the forward portion and the aft portion; and an actuation device operably joined to the at least one rod, wherein the actuation device is capable of adjusting the length of the rod during the flight path of the ballistic projectile subsequent to the launch of the ballistic projectile from the barrel to thereby maneuver the ballistic projectile;

wherein the ring member is located in a first axial position relative to the ballistic projectile prior to launch of the ballistic projectile and is located in a second axial position relative to the ballistic projectile subsequent to launch of the ballistic projectile, such that the first axial position of the ring member is axially closer to the ballistic projectile relative to the second axial position.

2. A ring tail according to claim 1 wherein the ring member defines a generally cylindrical wall.

3. A ring tail according to claim 2 wherein the ring member defines an inner surface and an outer surface opposed thereto, and wherein the ring tail further comprises a plurality of generally radially oriented panels joined to the outer surface of the ring member.

4. A ring tail according to claim 3, further comprising a second ring member having a generally cylindrical wall with an inner surface and an outer surface opposed thereto, wherein the plurality of generally radially oriented panels define a distal end opposite the outer surface of the first ring member, and wherein the inner surface of the second ring member is joined to the distal end of the plurality of generally radially oriented panels such that the first ring member and second ring member are coaxial.

5. A ring tail according to claim 3 wherein the ring member and generally radially oriented panels comprise a unitized structure of composite material.

6. A ring tail according to claim 1, further comprising an antenna mounted to the ring member for transmission of data.

7. A ballistic projectile launched from a barrel to define a flight path, the ballistic projectile comprising:

a mortar shell defining a forward section and an aft section opposed thereto; and a ring tail comprising:

a ring member having a wall with a forward end and an aft end opposed thereto, wherein during the flight path of the ballistic projectile air is capable of flowing around and through the ring member;

at least one rod having a forward portion joined to an aft section of the mortar shell and an aft portion joined to the forward end of the ring member, wherein the at least one rod has a length as measured between the forward portion and the aft portion; and an actuation device operably joined to the at least one rod, wherein the actuation device is capable of adjusting the length of the rod during the flight path of the ballistic projectile subsequent to the launch of the ballistic projectile from the barrel to thereby maneuver the mortar shell;

wherein the ring member is located in a first axial position relative to the ballistic projectile prior to launch of the ballistic projectile and is located in a second axial position relative to the ballistic projectile subsequent to launch of the ballistic projectile, such that the first axial position of the ring member is axially closer to the ballistic projectile relative to the second axial position.

8. A ballistic projectile according to claim 7 wherein the ring member defines a generally cylindrical wall.

9. A ballistic projectile according to claim 8, further comprising a plurality of generally radially oriented panels joined to the outer surface of the ring member.

10. A ballistic projectile according to claim 9, further comprising a second ring member defining a generally cylindrical wall with an inner surface and an outer surface opposed thereto, wherein the first ring member defines a central axis, the second ring member defines a central axis, and the plurality of generally radially oriented panels define a distal end opposite the outer surface of the first ring member, and wherein the inner surface of the second ring member is joined to the distal end of the plurality of generally radially oriented panels such that the first ring member and second ring member are coaxial.

11. A ballistic projectile according to claim 9 wherein the ring member and generally radially oriented panels comprise a unitized structure of composite material.

12. A ballistic projectile according to claim 7, further comprising a guidance sensor mounted to the mortar.

13. A ballistic projectile according to claim 12, further comprising an antenna mounted to the ring member for transmission of data from the guidance sensor of the mortar.

* * * * *